United States Patent [19]

Shadbolt et al.

[11] Patent Number: 4,542,052

[45] Date of Patent: Sep. 17, 1985

[54] TRANSFER IMAGING SYSTEMS

[75] Inventors: Philip Shadbolt; Graham E. Cassey, both of Ashford, England

[73] Assignee: Esselte Pendaflex Corporation, Garden City, N.Y.

[21] Appl. No.: 495,469

[22] Filed: May 17, 1983

[30] Foreign Application Priority Data

May 18, 1982 [GB] United Kingdom ..... 8214434

[51] Int. Cl.[4] ..... B41M 5/00

[52] U.S. Cl. ..... 428/40; 428/42; 428/201; 428/202; 428/204; 428/208; 477/147

[58] Field of Search ..... 428/40, 41, 42, 201–204, 428/200, 78, 914, 79, 208; 156/234, 235, 240, 249; 427/147; 430/961

[56] References Cited

U.S. PATENT DOCUMENTS

| | | | |
|---|---|---|---|
| 3,459,626 | 8/1969 | Morgan | 428/40 |
| 3,607,526 | 9/1971 | Biegen | 428/40 |
| 3,985,602 | 10/1976 | Stuart | 156/240 |
| 4,064,285 | 12/1977 | Mammino | 428/914 |
| 4,074,000 | 2/1978 | Hankee et al. | 428/914 |
| 4,090,464 | 5/1978 | Bishopp et al. | 428/40 |
| 4,124,431 | 11/1978 | Schramer et al. | 428/40 |
| 4,171,398 | 10/1979 | Hunt | 428/914 |
| 4,219,596 | 8/1980 | Takemoto et al. | 428/41 |
| 4,318,953 | 3/1982 | Smith | 428/200 |
| 4,383,878 | 5/1983 | Young et al. | 156/235 |
| 4,398,985 | 8/1983 | Eagan | 428/914 |
| 4,421,816 | 12/1983 | Arnold | 428/201 |
| 4,440,590 | 4/1984 | Collins et al. | 156/235 |

FOREIGN PATENT DOCUMENTS 1568226 5/1980 United Kingdom .

*Primary Examiner*—Bruce H. Hess
*Assistant Examiner*—William M. Atkinson
*Attorney, Agent, or Firm*—Darby & Darby

[57] ABSTRACT

Imageable products are described which can be made into dry transfer materials and other transfer materials by imaging them in an electrophotographic copier. The imageable products include an adhesive layer having a coating weight of between about 0.5 and 7 grams per square meter, releasably adhered to a substrate. A non-adhesive layer is applied over the adhesive layer, the non-adhesive layer having a thickness of less than about 30 microns and the non-adhesive layer being capable of accepting electrophotographic toner. The non-adhesive layer is incapable of being stripped from the substrate, to which said non-adhesive layer is releasably adhered by said adhesive layer, from a corner of said non-adhesive layer without fracture.

14 Claims, No Drawings

TRANSFER IMAGING SYSTEMS

This invention relates to transfer imaging systems.

There are many occasions in the manufacture of artwork, in offices, particularly drawing offices, and in other graphic work in which it is desired to reproduce an image from one surface onto a different surface.

Classically, this could only be done by making some of a sort of copy of the original and then using the copy to print or otherwise form the desired image in the new desired location. Such procedures were often very consumptive of time and materials.

With the advent of copying machinery, particularly electrophotographic copying machinery, in recent years it has become substantially simpler to make the initial copy, but this was generally produced on a sheet of paper which must then be e.g. adhered to the desired site to produce the artwork. While acceptable in some cases, this process is severely limited.

U.S. Pat. No. 4,171,398 discloses a method of making a dry transfer material using an electrophotographic copier. Instead of passing a sheet of plain paper through the copier, a multi-layer laminate with an adhesive surface is used and a toner image is deposited on this. This system is not without its drawbacks. In particular, the image though formed right reading is not right-reading when transferred, so two imaging steps must be carried out in order to produce a right reading copy legend from an originally right reading legend, e.g. in a book or on a card.

It is known in place of paper to pass laminated clear film through a xerographic copying machine. This laminate consists of a clear plastics sheet, having an adhesive coating holding the sheet temporarily adherent to a release coating on a backing sheet, e.g. of paper or plastics. When such a material has been imaged, sections of the clear plastics sheet bearing the desired image may be excised, and adhered using the layer of pressure sensitive adhesive to a desired substrate. This system requires fairly skilful manipulation and is of only limited value.

British Patent Specification No. 1568226 describes another approach. In that case, a release coated substrate, e.g. paper, bears a heat-transferable subbing layer onto which a xerographic toner image is deposited. That image, optionally after overcoating, can then be transferred under heat and pressure, with the subbing layer which detaches from the release coating, to a desired final surface e.g. a cloth T-shirt, or a sheet of plastics such as polyvinyl chloride, polyethylene or polyethylene terephthalate. Due to the necessity of using a heat-transfer step, this process is not of widespread applicability.

We have now found that satisfactory results may be achieved using as imageable material a substrate having releasably adhered thereto a plurality of layers, on the outer one of which the toner image is applied.

Thus, according to the present invention, in a first aspect, there is provided an imageable product consisting of a substrate having releaseably adhered thereto first a layer of an adhesive and over that layer a non-adhesive layer which is capable of accepting electrophotographic toner and which non-adhesive layer is incapable of being stripped from the base to which it is releaseably adhered by the adhesive from one corner without fracture. This is preferably achieved by making the layer sufficiently thin (e.g. less than 30 μm, preferably less than 20 μm) and/or by incorporating a shearing agent into the layer (e.g. finely divided silica).

This imageable product may be constructed in a number of ways in detail, depending upon the particular desired end use. However, in all cases, the material may be passed through an electrophotographic copying machine to emerge with the desired toner image thereon, and thereafter that toner image may be transferred, with the releaseable layer area which carries it, by an areal adhesion process, or more than one areal adhesion process, to its desired final resing place.

Thus, in a first alternative, the material of which the removable imageable layer is formed may be made of a plastics film which can be heat sealed to a suitable sheet. This product is useful for the manufacture of sub-surface signs i.e. signs consisting of a relatively substantial, normally rigid, sign sheet to the surface of which is adhered a legend, the legend being right reading when viewed through the substantially rigid sheet. Thus the imageable layer may be made of a suitable plastics film which can be heat sealed to the surface of a sign sheet made of transparent or translucent plastics material, for example cellulose acetate, polyvinyl chloride, polycarbonate resin, polystyrene resin or polymethylmethacrylate resin. In such a case, the imageable layer may be transparent or translucent, tinted or coloured or it may be opaque, e.g. filled with a white pigment.

In an alternative embodiment, the imageable layer may be a very thin plastics film which can be removed from the substrate by adhesion thereover of an adhesive coated sheet and subsequently pulling the adhesive coated sheet away from the substrate, the adhesive on the adhesive coated sheet being such that the soremoved area of imageable layer may be subsequently transferred to a desired substrate by laying the adhesive coated sheet on the desired final receptor with the removed imageable layer portion in contact with the receptor surface, rubbing over the back of the adhesive coated sheet to adhere the imageable layer portion to the receptor (via its own adhesive) more strongly than it is adhered to the adhesive coated sheet, and then peeling away the adhesive coated sheet to leave the imageable layer, still bearing its toner image, adherent to the desired receptor surface. By making the imageable layer sufficiently thin and giving it adequate surface matt properties, the area of imageable layer itself so transferred may be made to merge with or almost disappear into the background of the desired receptor surface.

An additional way of using this second alternative type is with an adhesive sheet of far greater adhesive power than that just noted, a portion of the adhesive sheet being brought first into contact with an imaged portion of the imageable layer and peeled away from the substrate to remove that imaged portion and the whole then being stuck down onto a desired receptor. This sort of product is useful as a labelling product, the strongly adhesive film, which must of course be transparent or translucent, acting to protect the image and being stuck firmly to the desired article e.g. an item of luggage or sports equipment, a box, drawer, box-file or the like.

A further approach is to use with the imageable product a transfer application sheet consisting of a carrier sheet having coated thereon a releaseable non-adhesive film to which the imaged area on the imageable product may be adhered. Such adherence may be secured in a number of ways e.g. by a layer of adhesive on the application film or it may be secured by using the electrophotographic toner material itself as a heat activated adhesive. Thus in one alternative, following imaging of the imageable product in an electrophotographic copying machine it is assembled together with an application material consisting of a support to which is releaseably adhered a clear non-adhesive carrier film and heat and pressure then applied to the assembly. But suitable choice of material for the clear carrier film the electrophotographic toner may be made to adhere to it more strongly than the toner accepting layer is adhered via its layer of adhesive to the substrate of the imageable product. On peeling the substrate of the imageable product and the support of the application sheet apart, the toner images come away with the support sheet, bringing with them, precisely in register, the non-adhesive layer from the imageable product and, outermost, the adhesive layer from the imageable product. This adhesive layer can then act to attach the image to a desired final receptor, the application sheet being used in the manner of a conventional dry transfer by laying it imaged side down on the desired receptor and rubbing over the back with a stylus e.g. a ball-point pen.

In place of using a heat transfer step relying on the thermo-adhesive properties of the electrophotographic toner, as just noted above, the application sheet may bear over a layer of clear carrier film a layer of heat activated or pressure sensitive adhesive which may be formulated either to remove only the toner imaged areas together with their underlying non-adhesive layer and adhesive layer from the imageable product or they may be formulated to remove the whole of the area of those layers over which pressure and if appropriate heat is applied, the whole area being subsequently transferred to a desired receptor surface or if appropriate only parts of it transferred, partial transfer being ensured first by cutting or scribing around the area it is desired to transfer.

It will be apparent that very wide variation may be effected in practice by changing the nature of the application sheet or the nature of the layers on that application sheet. Both physical and chemical changes may be made e.g. variation in layer thickness and variation in layer composition.

The individual components of the material of the invention and suitable for use in the systems just noted will not be considered in detail:

First, the substrate sheet should be a sheet of material which is appropriate for handling by conventional electrophotographic copiers. The preferred material is paper and this should of course be adequately stable thermally so that it can be used in copiers in which fusion of electrophotographic toner is effected by heating. Plastics films may be used, but they are generally more expensive and more sensitive to heat and are accordingly not preferred. The surface of the substrate must be adequate to enable removal of the imageable layer and its adhesive therefrom cleanly and reliably. This may be inherently the case if plastics film is used, but it is generally preferred to use a coated paper as the substrate. The paper may bear one or more coatings rendering its surface appropriate, these coatings generally being in the nature of so-called release coatings of which a very wide variety is known. Preferred release coatings for use in the present invention are siliconised coatings, and preferred substrates are clay-coated papers.

The imageable layer may vary very widely dependant upon the desired application. The layer may be transparent or translucent, dyed or pigmented. The thickness of the layer may vary substantially, but it should not be so thick that it is removable from the substrate using its own strength to pull itself away as a film from the substrate. The preferred materials for making the imageable layer are thermoplastics materials and tranparent or translucent film forming polymeric materials, particularly cellulose derivatives such as nitrocellulose. The layer should, of course, have a good affinity for electrophotographic toner materials. It should also have a low electrical conductivity, since otherwise difficulties arise in some electrophotographic copying processes.

The imageable layer is coated onto a layer of e.g. pressure sensitive adhesive initially coated onto the substrate so that when areas of the imageable layer are removed from the substrate by an areal adhesion process, the otherwise exposed surface of the imageable layer is covered with a layer of adhesive. That layer may be a pressure sensitive adhesive, and such is generally preferred for many applications, but other types of adhesives such as heat activated and moisture activated adhesives may be used for special purposes.

When the substrate is paper, and the imageable coating is a relatively water impermeable plastics film, the product may exhibit a tendency to curl. This is undesirable in sheets which are to be mechanically handled in electrophotographic copying machines and the side of the paper substrate removte from the imageable layer may in such cases be coated with a suitable anti-curl layer to prevent this from happening. A wide variety of materials is known for use in such circumstances. The material of choice is ethyl hydroxyethyl cellulose, coated at a suitable weight.

Care also needs to be taken in the construction of the substrate with the imageable material layer thereon that when sheets are piled in a stack, they can be easily removed from one another by conventional plain paper feed mechanisms used in known electrophotographic copiers. For example, the sheets should not exhibit any tendency to stick together which might cause malfunction in feeding.

As noted above, the properties of the imageable product may be varied quite substantially by varying the thickness of the two layers thereon and by varying their composition. Typically the adhesive layer should be coated at a coating weight of 0.5 to 3 gms/m$^2$, though higher coat weights e.g. up to 7 gms/m$^2$ can be used if desired for particular purposes. For many of the purposes noted above, coating weights of less than 3 gms/m$^2$ are entirely adequate. The coating weight of the imageable layer thereover can vary from about 0.5 to 20 gms/m$^2$. If it is desired to have good shearability in the imageable layer, then the coating weight should be at the lower end of this range and shearability can be provided by including a shearing promoting agent such as finely divided silica in the imageable layer. In the case that such a shearing promoting agent is not used, or when the coating is to be cut rather than sheared, the coating weight can be higher. The preferred coating weight for the imageable layer including a shear promoting component is less than 3 gms/m$^2$. If it is desired to use a high adhesive coating weight, then the preferred coating weight for the imageable layer is less than 1 gms/m$^2$ if good shearability is still required.

The tensile strength at break of the combination of coatings on the substrate is preferably less than 1.0 kg (kilogram) force/mm$^2$ (square millimeter) and the elongation of the two layers at break preferably less than 10%, most preferably less than 5%.

If the imageable product is to be used as indicated above with the assistance of an adhesive coated application sheet, that adhesive coated sheet should be constructed with care. Thus the sheet should be transparent or translucent in order to enable the imaged portion of the imageable layer to be seen through it, and the sheet should be of adequate strength and flexibility to be easily handled. Plastics films are ideal, for example, films of polyethylene, polyethylene terephthalate and polystyrene butadiene. The layer of adhesive on one side of the sheet may be a low tack pressure sensitive adhesive and this may be based on a wide variety of materials known for this purpose. Alternatively the adhesive may be a heat activatable adhesive or even, for special purposes, a solvent activated adhesive.

As noted above the application sheet may be designed as a multi-layer material in which the layers are intended to stay together, for example for a label tape product. Alternatively, there may be interposed between the adhesive layer and the support forming part of the application sheet a separating layer or the like enabling the release of one or more layers attached to the adhesive layer from the support. If the nature of the support itself is insufficient to enable this to be effected (and it is inherent in the case of some plastics films that applied layers may be peeled therefrom cleanly) then the plastics film may be coated with a suitable release layer or the like in order to achieve the desired separability.

One particularly preferred form of application sheet consists of a substrate bearing successively a release layer, a clear carrier film layer and a layer of a pressure sensitive adhesive. Most preferably the clear carrier film layer and adhesive layer are thin and shearable so that a portion of the layer may be removed together with an image which the layers have previously picked up from an imageable product.

In the case of application sheets which are used serving only as intermediate carriers for electrophotographically produced images which are subsequently transferred to a final receptor site, the application sheet then being removed, it is desirable to print on the side of the application sheet opposite the various coatings a square grid or set of lines in order to facilitate alignment of the images being transferred with one another if they are sequentially picked up from an imageable product material and as a group relative to the receptor when they are transferred to their final receptor position.

The following examples will serve to illustrate the invention:

EXAMPLE 1

There was used as substrate a commercially available silicone coated clay coated paper (Sterilease 46 ex. Sterling Coated Products). This paper is coated with a silicone resin on one side only.

First the non-silicone coated side of the paper was coated with a backing coat formulated as follows:

| | |
|---|---|
| Ethyl hydroxy ethyl cellulose (EHEC XLV ex Hercules) | 5 gms. |
| Oxitol | 15 gms. |
| Ethyl acetate | 30 gms. |
| Dye (Orasol Blue GN ex Ciba Geigy). | 0.075 gms. |

This coating was applied using a Meyer bar and the coating oven dried at 65° C. for one minute. The dry coating weight was 1 to 2 gms/m$^2$.

The siliconised side of the paper was then coated with an adhesive formulated as follows:

| | |
|---|---|
| Silica (Aerosil R972 ex Degussa) | 4.0 gms |
| Solvent (Exsol 145/160 ex Esso) | 113.8 gms |
| Oxitol | 9.0 gms |
| Polyisobutylene resin (Oppanol B50 ex BASF, 20% w/w solution in Exsol 145/160) | 15.7 gms |
| Polybutene resin (Hyvis 200 ex B.P.) | 6.9 gms |
| Polyethylene wax (ACP6 ex Allied Chemical, 10% w/w dispersion in Exsol 145/160) | 49.6 gms |

This formulation was applied using a Meyer bar and had a dry coating weight after oven drying at 65° C. for one minute of 2 to 2.5 g.s.m.

Onto the so-coated sheets was applied a nitrocellulose based film formulated as follows:

| | |
|---|---|
| Nitrocellulose solution (Grade 60:1990 ex Sonneborne and Rieck) | 39.57 gms |
| Oil modified azeleic acid type plasticising resin (Paraplex RGA2 ex Rohm and Haas) | 4.95 gms |
| Butyl Oxitol | 3.46 gms |
| Silicone fluid (1% solution in white spirit type MS200) | 0.10 gms |
| Oxitol | 48.08 gms |
| Silica (Aerosil R972 ex Degussa) | 3.85 gms |

This coating was likewise applied using a Meyer bar to give a dry coat weight of 1.5 to 2 gms/m$^2$ after drying for one minute in a laboratory oven at 65° C.

Sheets so prepared were imaged using a standard electrophotographic copier (type Xerox 3100) using a printed page as a master. The image of the printed page in electrophotographic toner was present on the sheet when it emerged from the electrophotographic copying machine.

An application sheet was prepared by coating a sheet of polyethylene terephthalate film 25 μm thick (Melinex type 542 ex I.C.I.) with a pressure sensitive adhesive. The adhesive used was a commercially available acrylic adhesive (Berger 5780 ex Berger Adhesives) and it was applied to the polyethylene terephthalate sheet thinned with xylene at a rate of 5 parts adhesive to 4 parts xylene by weight. Coating was effected using a Meyer bar and the sheet dried in a laboratory oven for one minute at 65° C. The coat weight was 4.5 gms/m$^2$.

In order to apply an image formed on an imageable material to a desired final receptor (a cardboard file) a piece of the application sheet slightly larger than the title it was desired to apply was cut from the application sheet and placed over the desired title on the imageable sheet. It was rubbed down gently using a finger and then pulled away. This pulled the image and its surrounding layer from the imageable material, the layers on that material shearing around the area where pressure had been applied. The title could then be applied to the card file cover simply by placing the piece of application sheet thereon and rubbing the sheet down firmly using a burnisher. After such rubbing the section of application sheet adheres to the card file cover and protects the toner image.

EXAMPLE 2

An imageable product sheet was manufactured as in EXAMPLE 1.

An application sheet was manufactured by coating a sheet of polyethylene terephthalate film (Melinex 542 ex I.C.I.) 75 μm thick successively with a release coat, a clear carrier film coat and an adhesive coat.

The fomulation of the release coat was:

| | |
|---|---|
| Ethyl Acetate | 34.6 gms |
| Xylene | 34.6 gms |
| Oxitol | 5.5 gms |
| Anti-static agent (ASA3 ex Shell Chemicals) | 0.2 gms |
| Polystyrene resin (Lustrex LX4300 Number Average Molecular weight 10,000 ex Monsanto) | 20.2 gms |
| Precipitated Calcium Carbonate (Calopake F ex Sturge Ltd.) | 4.9 gms |

This coating formulation was well milled and subsequently applied to the polyethylene terephthalate film using a Meyer Bar and subsequently dried to give a dry coat weight of 6.5 to 7.5 gms/m$^2$.

The formulation of the clear carrier film was as follows:

| | |
|---|---|
| Nitrocellulose (6156 ex Sonneborne and Rieck) | 68.95 gms |
| Caster oil modified glycerol azelate (Uralac 923/68 ex Synthetic Resins) | 14.18 gms |
| Dimethyl cyclohexyl adipate (Howflex SA ex Laporte) | 1.75 gms |
| Silica (Aerosil 130 V ex Degussa) | 1.32 gms |
| Oxitol acetate | 13.30 gms |

This formulation was applied by screen printing through a 95S mesh to give a dry film caliper of 6 μm, thickness. The sheet was then passed through a belt dryer with a residence time of 30 seconds during which the maximum temperature was 65° C. After drying, an adhesive was coated over the clear carrier film using a Meyer bar to give a dry coating weight of 2.5 gms/m$^2$ following drying for one minute in an oven at 65° C. The formulation of the adhesive was as follows:

| | |
|---|---|
| Polybutene resin (Hyvis 200 ex B.P.) | 5.6 gms |
| Polyisobutylene resin (Oppanol B50 15% by weight solution in Exsol 145/160, ex BASF) | 16.0 gms |
| Polyethylene Wax Dispersion (ACP6 ex Allied Chemical 10% weight dispersion in Exsol 145/160) | 80.0 gms |
| Silica (Aerosil R972 ex Degussa) | 4.0 gms |
| Oxitol | 16.0 gms |
| Solvent (Exsol 145/160 ex Esso) | 78.4 gms |

This application sheet was laid down on the xerographically imaged side of the imageable product and burnished into contact with the image over the whole of the desired image area. The application sheet was then pulled away which pulled the desired image from the imageable product. Using a scalpel the desired image area was then cut round while on the application sheet while leaving the image area attached thereto. Following cutting the application sheet with the transferred image downwards was laid over a piece of artwork onto which it was desired to transfer a design. The back of the application sheet was then burnished with a scriber in the area of the image. The application sheet substrate was then peeled away with its release coat to leave the desired image adhered to the artwork via the layer of adhesive originally forming part of the imageable product, the electrophotographic toner image being itself protected by overlying layers of adhesive and clear carrier film.

EXAMPLE 3

A silicone coated paper as used in Example 1 was coated on its siliconised side with a pressure sensitive adhesive formulation made up of:

| | |
|---|---|
| Polyisobutylene resin (Oppanol B50 as Example 2) | 12.0 gms |
| Polybutene resin (Hyvis 200 as Example 2). | 1.6 gms |
| Oxitol | 5 gms |
| Solvent (Exsol 145/160 ex Esso) | 21.4 gms |

This adhesive formulation was coated onto the siliconised side of the paper using a Meyer bar and the coating dried down to give a dry coating weight of 1.2 gms/m$^2$.

A nitrocellulose based layer was then applied from a formulation consisting of:

| | |
|---|---|
| Nitrocellulose solution (60:2200 ex Sonneborne & Rieck) | 34.25 gms |
| Caster oil modified glycerol azelate (Uralac 923/68 as Example 2) | 8.80 gms |
| Dimethyl cyclohexyl phthalate | 0.85 gms |
| Ethyl acetate | 5.45 gms |
| Xylene | 12.50 gms |

This coating was applied using a Meyer bar and the formulation dried down in an oven at 65° C. for one minute to give a dry coating weight of 15.0 gms/m$^2$.

Separately an application sheet was made by coating sheets of polyethylene terephthalate film (Melinex 542 ex I.C.I.) 50 μm thick with a low tack pressure sensitive adhesive coating of the following formulation:

| | |
|---|---|
| Polyisobutylene resin (Oppanol B50 as Example 2) | 9.60 gms |
| Polybutene resin (Hyvis 200 as Example 2) | 1.28 gms |
| Solvent (Exsol 145/160 ex Esso) | 6.32 gms |
| Oxitol | 2.00 gms |
| Silica (Aerosil R972 ex Degussa) | 0.80 gms |
| Anti-static agent (ASA3 ex Shell Chem.) | 0.012 gms |

This adhesive was thinned with a mixture of 3 parts by weight solvent per part of mixture prior to application. The thinning solvent was a 5:1 weight for weight mixture of Exsol 145/160 and Oxitol. The thinned adhesive was applied using a Meyer bar and the coated sheets dried in an oven at 65° C. for one minute. The dry coat weight of the adhesive coating was 0.4 to 0.5 gms/m$^2$.

In order to produce a transferable desired image the imageable product was imaged in a standard electrophotographic copier as in Example 1. Thereafter a portion of the image which it was desired to transfer to an article was separated from the remainder of the imaged layer in the imageable product by cutting around it with a scalpel. The application sheet was then placed adhesive side down on top of the cut out portion and the application sheet burnished down using a scriber, particular care being taken to burnish firmly at the edges of the removable area. On peeling away the application sheet the cut out area was removed with it and then positioned where desired over a piece of artwork, adhesive side down. Further burnishing on the back of the application sheet then caused the layers from the imageable product bearing the image to adhere to the receptor more strongly than they adhered to the application sheet, so that on peeling away the application sheet the desired image was left adherent to the desired final receptor in the desired position. The application sheet could then be re-used.

EXAMPLE 4

An imageable product was prepared as described in Example 1 except that in place of the adhesive formulation used there, an adhesive composition consisting of 30 parts by weight of a commercial pressure sensitive acrylic adhesive (Berger 5783 ex Berger Adhesives) diluted with 40.5 parts by weight of xylene was used. The coating composition so formed was coated using a Meyer bar and the wet coating composition then dried in an oven at 65° C. for one minute to give a dry coating weight of 6.5 to 7.0 gms/m$^2$.

Using the same application sheet as described in Example 1, an application sheet was applied to the area of the imageable product which it was desired to transfer to a final receptor and the application sheet pressed into contact therewith by rolling over using a hand held roller. On peeling away the application sheet the electrophotographically printed image came away too and could be subsequently transferred to an acrylic sheet material using applied roller pressure to form a sign.

EXAMPLE 5

A coated paper as described in Example 1 was imaged using a Xerox 3100 photocopier. The image was a slogan which it was desired to incorporate into a sign and in order to do so a sheet of polymethylmethacrylate (Clarex acrylic sheet ex Nitto Jushi Kogyo Co. Limited) was applied gloss side down to the legend. The assembly so formed was then passed through a heated nip on a sign making machine (ex ASI Sign Systems Inc) to cause the legend to become adherent to the acrylic sheet more strongly than it was adherent to the backing paper. The laminating machine was run at a speed of 2.7 revolutions per minute and a Thermax Recording Strip passed through the heated nip recording a temperature of 104° C.

When the acrylic sheet had cooled the backing paper was peeled off leaving the image firmly adherent to the acrylic sheet, the assembly then constituting a right-reading subsurface sign.

EXAMPLE 6

Example 5 was repeated except that the topmost layer of the imageable product sheet was applied using a Meyer bar by coating a coating composition of the following formulation:

| | |
|---|---|
| Titanium dioxide pigment (Runa RH52 ex Laporte) | 28.24 gms |
| Nitrocellulose solution (6156 ex Sonneborne & Rieck) | 45.46 gms |
| Epoxidised soya bean oil (Paraplex G25 ex Rohm & Haas) | 17.18 gms |
| Alkyl substituted acid amide wax in gel form (Dehysol ex Henkel) | 0.94 gms |
| Poly 2-ethyl hexyl acrylate (Modaflow ex Monsanto) | 0.94 gms |
| Oxitol | 7.25 gms |
| Ethyl acetate | 10.00 gms |
| Xylene | 15.00 gms |

The dry coating weight was 180.0 gms/m$^2$.

In addition, the temperature of the heated nip and its speed were increased and decreased respectively to 127° C. (Thermax Recording Strip) and 3.0 revolutions per minute. Under these conditions, the entire white layer together with the applied xerographic black image was transferred to the acrylic sheet giving a right-reading subsurface sign consisting of a black legend on a white background.

EXAMPLE 7

The imageable product was used as in Example 1 and in conjunction with an application sheet consisting of a polyester film (75 μm thick Melinex 542 ex I.C.I.) coated with a release coating as set forth in Example 2 above, whereafter a shearable nitrocellulose clear carrier film was coated on top of the release coating. The wet nitrocellulose coating was dried in an oven at 65° C. for one minute to give a dry coat weight of 0.8 to 1.0 gms/m$^2$. The fomulation of the nitrocellulose film was as set out in Example 1.

In order to form a dry transfer material, an original was placed on the platen of a Xerox 3100 photocopier and the imageable product placed in the in-feed tray. The photocopier was operated in the normal manner and the imaged product emerging was passed together with the application sheet through a heated nip. Prior to passing the assembly of imaged product and application sheet through the nip, the assembly was encased by a sheet of thin card on each side. The heated nip was provided by an ASI Sign Systems Inc. sign making machine as described above, which was run at a speed of 2.7 revolutions per minute and a Thermax Recording Strip nip temperature of 104° C.

The application sheet was then peeled from the imaged product while both were still warm, bringing with it the xerographic toner images, which images could be subsequently transferred to a desired receptor by using the application sheet as a normal dry transfer material i.e. by laying it imaged side down onto the desired receptor and rubbing over the back using a high applied pressure e.g. using a ball-point pen, scriber or burnishing tool. It is found that the clear carrier film shears cleanly around the edge of the xerographic toner images.

EXAMPLE 8

A coated paper as described in Example 3 was imaged using a Minolta EP.520 copier. This copier uses heated roller fusion to fix the toner and thus requires the use of silicone oil to prevent set off of the toner onto the heated rollers. Some of the silicone oil is deposited on the imageable sheet, which prevents an application sheet as set out in any of the previous Examples from working.

An application sheet was made by coating a sheet of polyethylene terephthalate film (Melinex 542 ex I.C.I.) 50μ thick with a low tack silicone pressure sensitive adhesive coating of the following formulation:

| | |
|---|---|
| Silicone adhesive (Dow Corning 282) | 148 gms |
| Silica (Aerosil R.972) | 22 gms |
| Polyethylene wax dispersion (as in Example 2) | 110 gms |
| Solvent (Exsol 145/160, ex Esso) | 610 gms |
| Oxitol | 110 gms |

This adhesive was applied using a Meyer bar and dried in an oven at 60° C. for one minute, to give a dried coating weight of between 0.4 and 0.5 gms/m$^2$.

The required image on the imaged paper was cut out using a scalpel. The application sheet was then placed adhesive side down on top of the cut out image and the area burnished as in Example 3. The adhesive on the application sheet adheres sufficiently well to the toner image and the cut out sheet was peeled away, the image and cut out layers were removed from the coated paper. They could then be located where desired over a piece of artwork and the required image finally transferred thereto by burnishing over the back of the film and peeling the film away.

The application sheet just described may be used in the other Examples if the type of copier used to image the imageable material deposits silicone oil on the imageable material when fixing the toner image thereon.

We claim:

1. Transfer material comprising:

an imageable product including a substrate, a first adhesive layer releasably adhered to said substrate, and a non-adhesive imageable layer applied over said first adhesive layer, said imageable layer being capable of accepting electrophotographic toner and being of insufficient strength to be stripped from said substrate, to which said imageable layer is releasably adhered by said first adhesive layer, from a corner of said imageable layer without fracture, and an electrophotographic toner image applied to said imageable layer; and a light-transmitting sheet adherent to said imageable layer bearing said toner image, whereby said substrate and said light-transmitting sheet are separable, with said imageable layer bearing said toner image and said first adhesive layer adhering to said light-transmitting sheet at least where said toner image is applied to said imageable layer.

2. Transfer material according to claim 1 wherein said light-transmitting sheet includes a second adhesive layer for adhering said sheet to said imageable layer bearing said toner image, the relative adhesive strength of said second adhesive layer and of said first adhesive layer being such that after the separation of the transfer material and application to a receptor surface, said sheet may be removed to leave said imageable layer bearing said toner image adhering to said receptor surface.

3. Transfer material according to claim 1 wherein said imageable layer includes a shearing agent.

4. Transfer material according to claim 1 wherein said light-transmitting sheet comprises a light-transmitting plastics sheet, and a pressure-sensitive adhesive layer applied to said sheet, said pressure-sensitive adhesive layer being adhered to said imageable layer bearing said toner image.

5. Transfer material according to claim 4 wherein said light-transmitting sheet overlaps said imageable product whereby said presure-sensitive adhesive layer of said light transmitting sheet is available for adhering to a receptor surface.

6. Transfer material according to claim 1 wherein said imageable layer comprises a plastics film and said imageable layer bearing said toner image is adhered to the surface of a light-transmitting plastics sheet by heat sealing, whereby a subsurface sign is formed.

7. Transfer material according to claim 6 wherein said imageable layer is pigmented.

8. A dry transfer material comprising an imageable product comprising a substrate having releaseably adhered thereto a first layer of adhesive and over said first layer a non-adhesive imageable layer which is capable of accepting electrophotographic toner, which is of insufficient strength to enable said imageable layer to be stripped from the substrate to which said imageable layer is releaseably adhered by said first adhesive layer from one corner without fracture alone without an overlying application sheet, and having an electrophotographic toner image on said imageable layer, and a light-transmitting application sheet adherent to the toner image bearing imageable layer, whereby on separation of said substrate and application sheet in the image areas, said imageable layer and first adhesive layer material are retained on said application sheet.

9. Material according to claim 8 wherein said image areas of said imageable product are cut around and said application sheet is adhered at said image areas only.

10. Material according to claim 8 wherein said application sheet has an adhesive coating and said application sheet is adhered by means of said adhesive coating to the toner image bearing image layer only in the image areas.

11. Transfer material according to claim 8 wherein said imageable layer includes a shearing agent.

12. Material according to claim 8 wherein said application sheet comprises a carrier sheet having thereon a releaseable non-adhesive coating said coating adhered to said imageable prduct only in said image areas and wherein after said separation and application of the material so obtained to a receptor surface and said application sheet is removed, said non-adhesive coating is retained on the toner image bearing imageable layer material adhering to said receptor surface.

13. Material according to claim 12 wherein said electrophotographic toner is a heat activated adhesive and said toner image is adhered to said releaseable non-adhesive coating by heat sealing.

14. In the method of making a transfer material which includes the step of passing an imageable product through an electrophotographic copying apparatus in order to deposit a toner image on said imageable product, the improvement comprising using a transfer material having an imageable product including a substrate, a first adhesive layer releaseably adhered to said substrate, and a non-adhesive imageable layer applied over said first adhesive layer, said imageable layer being capable of accepting electrophotographic toner and being of insufficient strength to be stripped from said substrate, to which said imageable layer is releaseably adhered by said first adhesive layer, from a corner of said imageable layer without fracture, and an electrophotographic toner image applied to said imageable layer; and a light-transmitting sheet adherent to said imageable layer bearing said toner image, whereby said substrate and said light-transmitting sheet are separable, with said imageable layer bearing said toner image and said first adhesive layer adhering to said light-transmitting sheet at least where said toner image is applied to said imageable layer.

* * * * *